United States Patent [19]

Charles et al.

[11] 4,269,565

[45] May 26, 1981

[54] TURBINE WHEEL

[76] Inventors: Roger D. Charles, 322 Olive Ave., Pt. St. Lucie, Fla. 33452; Earl Charles, Jr., 6311 Oleander Ave., Ft. Pierce, Fla. 33450; Robert C. Stedman, 1756 Captains Pl., Sea Gate Harbor, Stuart, Fla. 33494

[21] Appl. No.: 60,684

[22] Filed: Jul. 25, 1979

[51] Int. Cl.[3] ..... F01D 1/34; F03B 5/00

[52] U.S. Cl. ..... 415/76; 415/90; 415/203; 415/212 R; 416/236 R

[58] Field of Search ..... 415/76, 90, 91, 203, 415/212 R, 213 R, 213 C, 213 T, 165; 416/223 R, 223 A, 236 R, 236 A, 237, 243

[56] References Cited

U.S. PATENT DOCUMENTS

| | | | |
|---|---|---|---|
| 784,482 | 3/1905 | Duc, Jr. | 415/91 |
| 3,059,834 | 10/1962 | Hausammann | 416/223 A X |
| 3,168,235 | 2/1965 | Valdi | 415/213 C X |
| 3,932,057 | 1/1976 | Wadensten | 415/213 T X |

*Primary Examiner*—Stanley N. Gilreath

*Attorney, Agent, or Firm*—Cushman, Darby & Cushman

[57] ABSTRACT

A turbine wheel for a low-speed, single-stage turbine is constructed with a large number of blades which extend radially outward in planes normal to the axis of rotation of the wheel, each blade having a relatively sharp leading edge and a thicker body portion which merges smoothly with the leading edge. In the preferred construction each blade in transverse cross-section is diamond shaped and is arranged with two of its opposite sharp edges forming the leading and trailing edges of the blade.

10 Claims, 7 Drawing Figures

TURBINE WHEEL

This invention relates to turbine wheels and in particular to a special shape and arrangement of the blades of a single stage turbine wheel.

BACKGROUND OF THE INVENTION

Examples of single stage turbine wheels having a plurality of radially projecting blades are described in U.S. Pat. Nos. 3,404,867 and 3,923,416. The turbine wheel of U.S. Pat. No. 3,404,867 is constructed of a plurality of coaxial discs each of which has circumferentially spaced concave cut-outs to provide a plurality of arms. The blades in the turbine wheel of U.S. Pat. No. 3,923,416 are in the form of radially projecting wires.

SUMMARY OF THE INVENTION

According to the present invention a turbine wheel is constructed with a large number of closely-spaced, radially projecting blades lying in planes normal to the axis of rotation of the wheel, each blade being of airfoil shape in the sense that it has relatively sharp leading and trailing edges and a thicker body portion which merges smoothly with the leading and trailing edges. The plane of each blade is "normal" to the axis of the wheel in the sense that this plane intersects a horizontal plane containing the axis of the wheel at a right angle. Thus the plane of each blade may be angled slightly with respect to the axis of the wheel. The preferred blade shape is prismatic, i.e. diamond shape in transverse cross-section, with two of the sharp edges of the diamond shape forming the leading and trailing edges of the blade. The distance between these two edges will generally be greater than the distance between the other two edges, with the result that the blade is elongated in the circumferential dimension of the wheel. The length to width ratio may be, for example, about 6 to 1 and the angles of the leading and trailing edges may be quite acute, for example 16°. Each blade subtends only a very small part of the outer circumference of the wheel, for example 1°.

The outer end or tip portion of each blade is shaped to form a relatively sharp edge which lies in the plane of the blade and which faces outwardly from the wheel. This contour can be formed by grinding or milling each of the four flat surfaces of the prism-shaped blade body so that each of these surfaces is planar and inclines upwardly and inwardly toward the plane of the blade. The forward and leading edges of the blade are also ground to convex contours in the area of the inclined surfaces so that when the blade is viewed from one side the leading and trailing edges at the tip portion of the blade are curved about axes parallel to the axis of the wheel.

The blades are arranged in uniformly spaced apart relationship in a plurality of rows which extend parallel to the axis of the wheel. The blades in one row are staggered or offset with respect to the blades in the two adjacent rows and the rows may be arranged close to each other so that the leading edges of the blades in one row and the trailing edges of the blades in an adjacent row lie in or close to a common plane. In a given row the blades are spaced apart by about two blade widths. The distance between the trailing edge of a blade in one row and the leading edge of a coplanar blade in a next-but-one or alternate row is at least one blade length. The ratio of the height of the blades to the overall diameter of the wheel can be quite small, for example, 1 to 14. That is, the blades can be located on the circumference of a relatively large diameter hub.

A turbine wheel constructed in accordance with the principles of the present invention is an efficient, low speed power converter for a single stage turbine. The wheel is particularly advantageous in providing an excellent combination of high efficiency of energy conversion with low weight and compact construction. These advantages are achieved as a result of the blade design which, for each blade, dislocates the laminar flow of the power fluid, causing the least amount of fluid turbulence. Each dislocation of the flow transfers a small part of the kinetic energy of the fluid to the blade and so will be transmitted to the shaft of the wheel. More specifically, the blade design of special supersonic airfoil shape causes very little turbulence in the fluid flow. The upstream or leading faces of each blade preferably are polished so as to offer only slight resistance to the fluid flow and thereby cause the least amount of turbulence. The kinetic energy of the high velocity power fluid is transferred to the hub and shaft as relatively low-speed torque by a low pressure area on the downstream or trailing faces of the blade. This transfer cannot be considered a wholly friction transfer. Thus, the full amount of energy introduced to the wheel by a power fluid issuing from a nozzle is taken up by the large number of blades, each taking some energy from the flow until at a point downstream the centrifugal force of the fluid is greater than the tangential force and the fluid will leave the periphery of the wheel.

DETAILED DESCRIPTION

Figure 2:
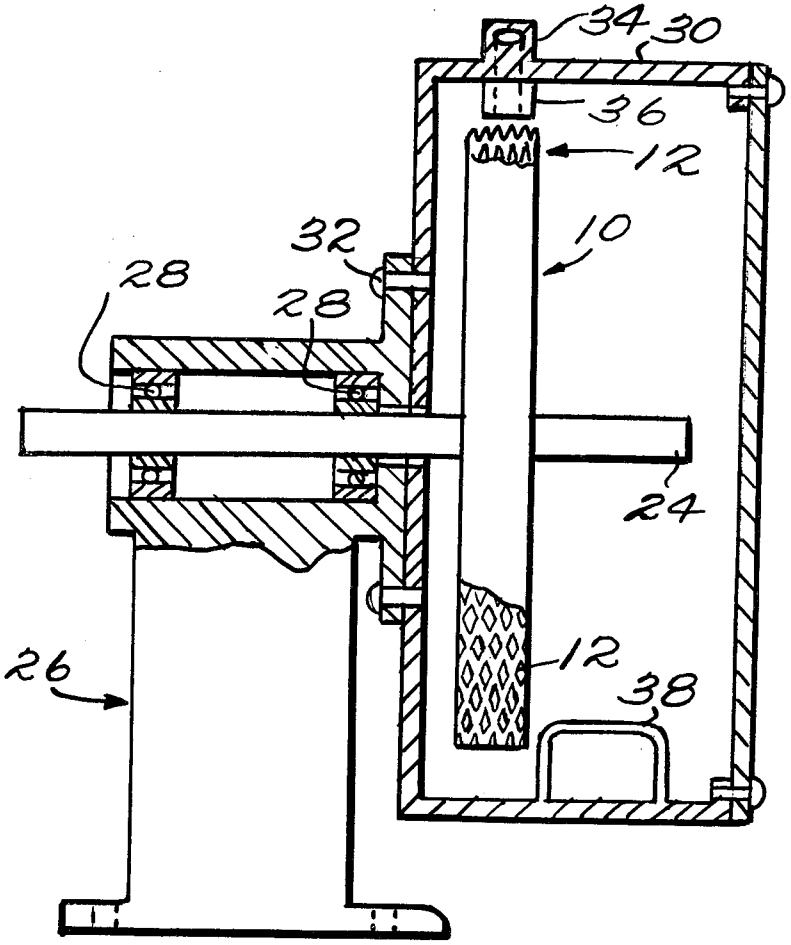
FIG. 2 is a sectional view taken on the line 2—2 of FIG. 1.
Figure 1:
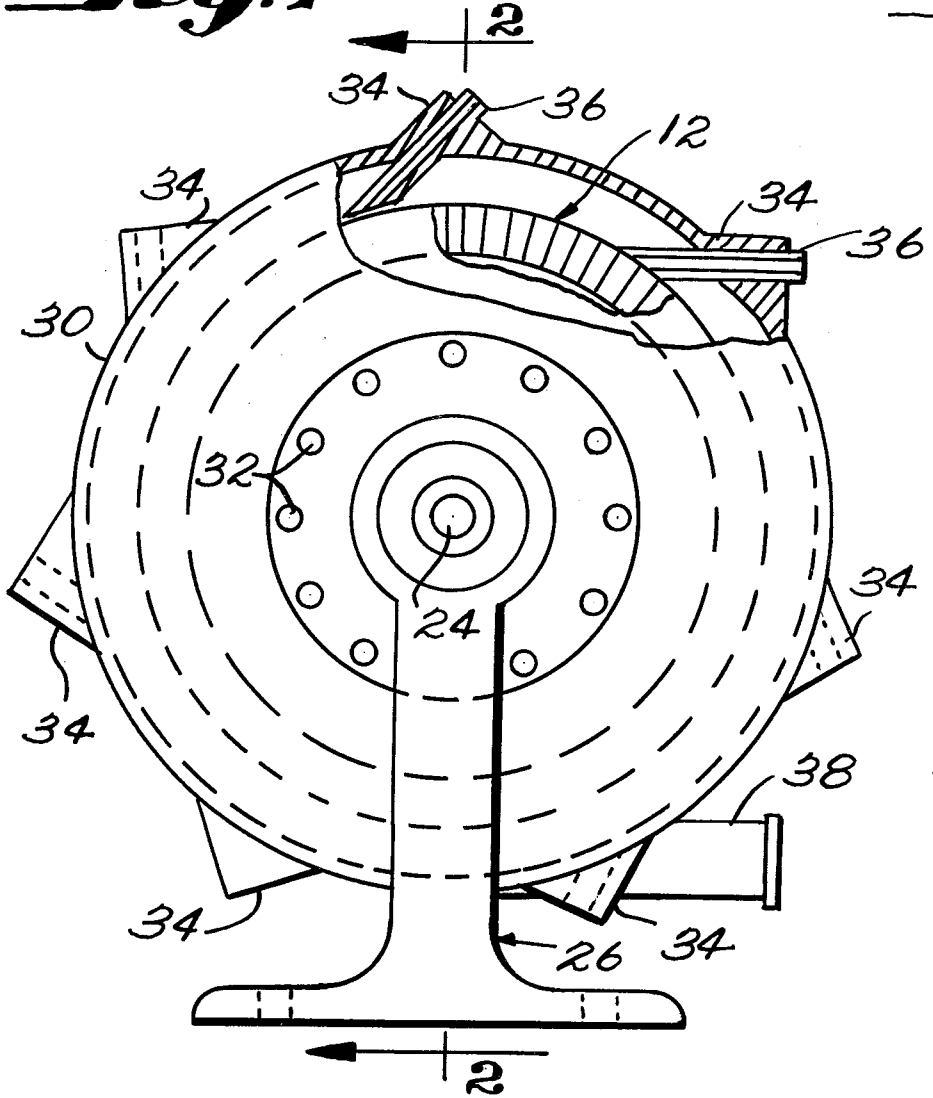
FIG. 1 is a schematic elevational view, partly broken away, of a turbine having a turbine wheel embodying the principles of the present invention.

FIGS. 1 and 2 illustrate, schematically, a single stage turbine such as a steam turbine. The turbine includes a turbine wheel 10 which carries at its circumference a plurality of blades 12 having a configuration and arrangement according to the present invention.

The turbine wheel 10 has a central hub portion which is fixed to a power output shaft 24 which is journalled relative to a fixed stand 26 by bearings 28. A cylindrical turbine wheel housing 30 surrounds the turbine wheel 10 and is supported by the stand, as by screws 32. The exterior of the housing 30 is provided with a plurality of circumferentially spaced-apart nozzle mounts 34 each of which is adapted to receive a removable adjustable steam nozzle 36 or other power fluid injection device. The nozzles 36 direct the power fluid in the form of a jet which is approximately as wide as the axial dimension or thickness of the turbine wheel 10. The power fluid leaves the housing 30 through an exhaust tube 38 which is tangential to the housing 30 and to the turbine wheel 10.

The special shape of the turbine blades 12 is best shown in FIGS. 3–7. Each blade 12 is prism shaped in the sense that in transverse cross-section it is diamond shaped. Each blade 12 projects radially with respect to the wheel 10 in a plane normal to the axis of the wheel, and in the illustrated embodiment this plane is also at a right angle to the axis of the wheel. The blades 12 are elongated in the front to rear direction and are arranged so that the acutely angled edges of the prism shapes form the leading and trailing edges 40 and 42 of the blades.

Figure 7:
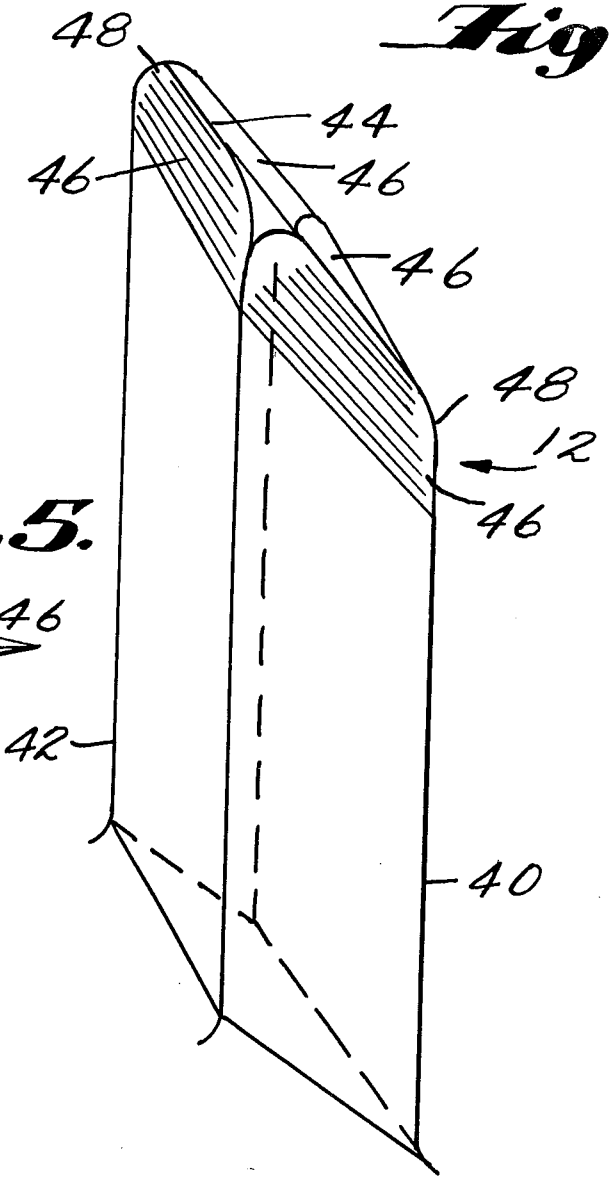
FIG. 7 is perspective view of the blade of FIG. 5.
Figure 5:
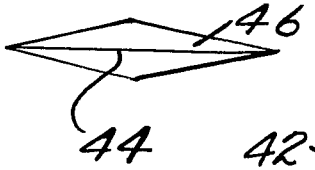
FIG. 5 is a top view of a single turbine blade.
Figure 4:
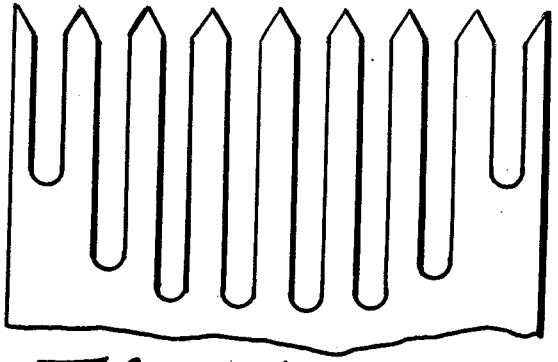
FIG. 4 is a sectional view taken on the line 4—4 of FIG. 3.
Figure 6:
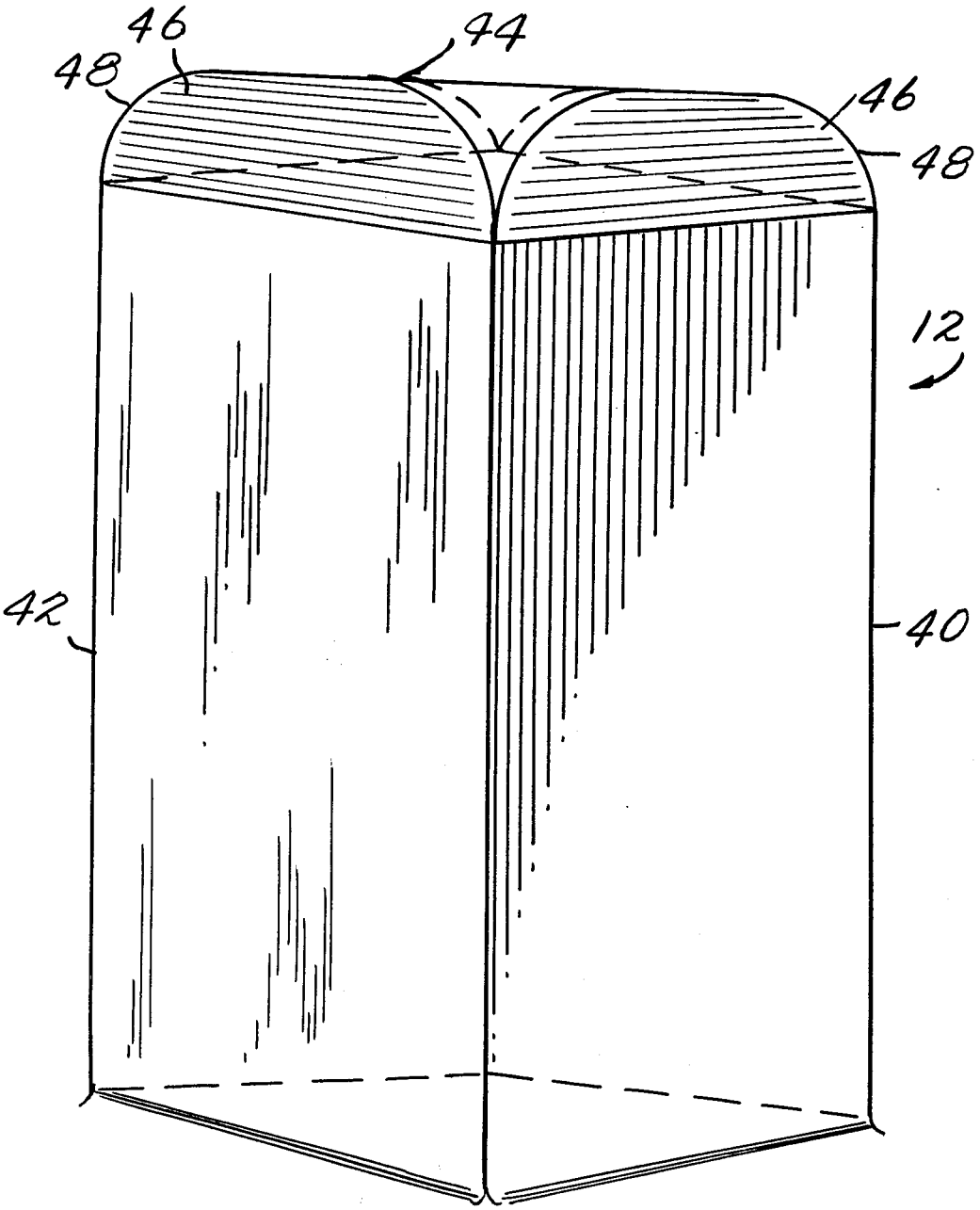
FIG. 6 is a side view, on an enlarged scale, of the blade of FIG. 5.

The body portion of each blade 12 is of uniform transverse cross-section throughout its height and has planar surfaces. The outer end or tip portion of each blade 12 tapers inwardly and upwardly to form a relatively sharp upper edge 44 which lies in the plane of the blade. This contour may be formed by grinding or milling or otherwise cutting away a portion of each of the planar surfaces of the prism-shaped body portion of the blade 12 so as to provide four planar tip surfaces 46 each of which is inclined upwardly and inwardly. The leading and trailing edges in the tip portion are ground or otherwise shaped to uniformly convex sharp edges 48 as seen in FIGS. 6 and 7. It has been found that the blades 12, that is the entire bladed wheel 10, can be fabricated from a solid cylindrical blank, an operation which includes milling or grinding slots into the circumference of the blank, starting at the periphery of one face and proceeding at an angle of 8° to the opposite face. The milling or grinding results in a cup-shaped contour when viewed in cross-section, as seen in FIG. 4.

Figure 3:
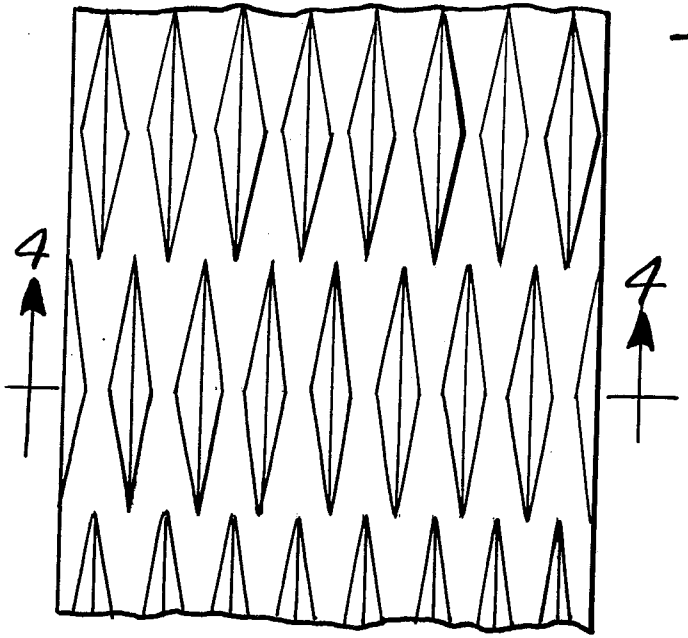
FIG. 3 is a partial plan view, on an enlarged scale of the turbine wheel of FIGS. 1 and 2.

As seen in FIG. 3 the blades 12 are arranged in uniformly spaced-apart relationship in rows 50 which extend parallel to the axis of the wheel. The blades 12 in each row are staggered with respect to the blades 12 in the two adjacent rows, and the blades 12 in alternate rows are coplanar.

In operation of the turbine, steam or other high pressure, high velocity power fluid is supplied to one or more of the nozzles 36 so as to impinge on the adjacent blades 12. The power fluid at low pressure and low velocity leaves the turbine housing through the exhaust tube 38. The shrouds 20 channel the incoming power fluid jet so as to prevent bending of the blades, which because of their dimensions may be flexible.

What is claimed is:

1. A turbine wheel comprising a rotary hub and a plurality of blades projecting outwardly from the periphery of the hub, each of said blades lying generally in a radial plane which is transverse to the axis of rotation of the hub, each of said blades having a height, a width and a length extending generally in the circumferential direction of the wheel whereby each blade has a leading edge and a trailing edge, the height being less than the length and the width varying along the length of the blade so as to form relatively sharp leading and trailing edges and an intermediate portion of greater thickness, the leading and trailing edges merging smoothly with said intermediate portion, said blades being arranged in a spaced-apart parallel relationship in a plurality of rows which extend parallel to the axis of the hub.

2. A turbine wheel as in claim 1 wherein the blades in one row are offset with respect to the blades in each adjacent row.

3. A turbine wheel as in claim 1 or 2 wherein the length to width ratio of each blade is about 6 to 1.

4. A turbine wheel as in claim 1 or 2 wherein the blades in a given row are spaced apart by about two blade widths.

5. A turbine wheel as in claim 2 wherein the distance between the trailing edges of the blades in one row and the leading edges of the blades in an alternate row is at least one blade length.

6. A turbine wheel as in claim 1 or 2 wherein each blade is diamond-shaped in cross-section.

7. A turbine wheel as in claim 6 wherein the sides of the tip portion of each blade are inclined upwardly and inwardly to form a sharp edge which faces outwardly with respect to the hub.

8. A turbine for converting the kinetic energy of a power fluid to rotary mechanical energy comprising a turbine wheel as in claim 1 or 2, a housing surrounding the wheel, means for introducing the power fluid to the periphery of the wheel generally in the direction of rotation of the wheel so that the power fluid impinges on said blades, and means for exhausting the power fluid from the housing.

9. A turbine wheel for converting kinetic energy of an expandable power fluid to rotary mechanical energy comprising a rotary hub having a plurality of rows of spaced-apart blades arranged on its periphery, the rows extending parallel to the axis of rotation and each of said blades being elongated in the circumferential direction of the wheel and having a sharp leading edge, a sharp trailing edge and an intermediate portion of greater thickness merging smoothly with the leading and trailing edges.

10. A turbine comprising a turbine wheel as in claim 9 and means for supplying expandable power fluid to the periphery of the wheel in a circumferential direction so that the fluid impinges on the blades in the direction of rotation of the wheel.

* * * * *